United States Patent [19]

Takahashi et al.

[11] Patent Number: 4,621,420

[45] Date of Patent: Nov. 11, 1986

[54] PROCESS FOR MANUFACTURING AN ELECTRODE

[75] Inventors: Yoshinobu Takahashi; Takanobu Mori; Masamitsu Odanaka; Haruo Murase; Masayuki Kojima, all of Toyota, Japan

[73] Assignee: Toyota Jidosha Kabushiki Kaisha, Toyota, Japan

[21] Appl. No.: 617,275

[22] Filed: Aug. 7, 1984

Related U.S. Application Data

[62] Division of Ser. No. 407,490, Aug. 12, 1982, Pat. No. 4,473,453.

[51] Int. Cl.[4] ..... H01R 43/00

[52] U.S. Cl. ..... 29/856; 29/825; 204/299

[58] Field of Search ..... 29/825, 854, 856; 204/286, 294; 429/44, 45; 339/278 D

[56] References Cited

U.S. PATENT DOCUMENTS

| | | | |
|---|---|---|---|
| 510,899 | 12/1893 | Cutten | 339/278 D X |
| 3,244,610 | 4/1966 | Brown et al. | 204/286 X |
| 3,657,100 | 4/1972 | Childs | 204/294 X |
| 3,708,416 | 1/1973 | Ruehlen et al. | 204/294 X |
| 4,265,725 | 5/1981 | Tatum | 29/854 X |
| 4,394,238 | 7/1983 | Golimowski et al. | 29/825 X |

*Primary Examiner*—Mark Rosenbaum
*Assistant Examiner*—Carl J. Arbes
*Attorney, Agent, or Firm*—Oblon, Fisher, Spivak, McClelland & Maier

[57] ABSTRACT

An electrode of a metal oxide sintered mass, comprising: an electrode body having therein a metal member as a core the outer circumference of which is covered with an electroconductive material and a metal oxide sintered mass; and a sheathed lead wire joined to said electrode body, the joint therebetween being covered with a resin.

8 Claims, 13 Drawing Figures

PROCESS FOR MANUFACTURING AN ELECTRODE

This is a division, of application Ser. No. 407,490, filed Aug. 12, 1982, now U.S. Pat. No. 4,473,453, issued Sept. 25, 1984.

BACKGROUND OF THE INVENTION

This invention relates to an electrode formed of a sintered mass of a metal oxide to be used for coating by cationic electrodeposition and to a method for electrodeposition coating by use of the electrode mentioned above.

BACKGROUND OF THE INVENTION

In recent years, increasing importance has come to be attached to the improvement in anti-corrosion in the case of coating automobile bodies. The measures for anti-corrosion have been studied in terms of base materials, chemical treatments, types of paints, manners of paint application, automobile body designs, etc. from various angles. Among others, the technique of electrodeposition coating constitutes the most effective and economic method for rendering anti-corrosive the inner surfaces of complicated and hollow structures such as automobile bodies, for example, and even those portions which do not readily permit spray coating. Thus, the electrodeposition coating is extensively used today.

The conventional method for electrodeposition coating has preponderantly used anionic electrodepositing paints in consideration of the low cost of paints so used, the relatively low temperature of baking paints, and the relatively low cost of equipment involved. In accordance with the method for anionic electrodeposition coating, however, the article subjected to coating which is used as an anode is dissolved out in the course of electrodeposition coating, whereas the cathode such as of iron immersed in the electrodepositing cell or paint is not dissolved out. Consequently, the effect of the chemically formed coat is degraded and the thickness of the coat formed on the surface of the article to be coated under treatment is small. Accordingly, with the progressive aggravation of the corrosive environment, it has been proved that the conventional anionic electrodeposition coating is not necessarily satisfactory. For this reason, the technique of cationic electrodeposition coating has recently come to find increasing acceptance.

To effect the cationic electrodeposition coating, a water-insoluble polyamine resin, $R\text{-}NH_2$, is obtained by adding a primary amine or secondary amine to the glycidyl group of a water-insoluble resin such as, for example, a bisphenol type epoxy resin thereby effecting ring cleavage thereof, and then an organic acid such as acetic acid or lactic acid is caused to react, as a neutralizing agent (water-solubilizing agent) AH, with the aforementioned water-insoluble polyamine resin to produce an aqueous resin, $R\text{-}NH_3^+$, as shown by the following reaction formula (I).

$$R\text{-}NH_2 + AH \rightarrow R\text{-}NH_3^+ + A^- \quad \text{(I)}$$

In a cationic electrodepositing paint solution formed of the aforementioned water-soluble resin, and if necessary, a crosslinking agent and a pigment, an article to be coated is immersed as a negatively charged electrode (hereinafter referred to as "cathode"). Separately a positively charged electrode (hereinafter referred to as "anode") such as of stainless steel or carbon is immersed in the same solution. Electric current is passed between the cathode (the article under treatment) and the anode.

By the passage of the electric current, the positively charged paint components electrophoretically migrate in the solution and, on arrival at the article (the cathode) coagulates and precipitates by emitting the electric charges as shown by the following formula (II) and gives rise to a water-insoluble coat on the article.

$$2H_2O + 2e^- \rightarrow H_2 + 2OH^-$$

$$OH^- + R\text{-}NH_3 \rightarrow R\text{-}NH_2 + H_2O \quad \text{(II)}$$

On the anode which is made of a metal such as, for example, stainless steel as indicated in the formula (III), generation of metal ions and simultaneous evoluation of oxygen shown by the formula (IV) are observed.

$$M \rightarrow M^{n+} + ne^- \quad \text{(III)}$$

$$4OH^- \rightarrow O_2 \uparrow + 2H_2O + 4e^- \quad \text{(IV)}$$

In case the anode is made of carbon, since it is not a metal, the dissolution indicated by the formula (III) does not occur, but the evolution of oxygen through the reaction of the formula (IV) does occur. Consequently, the carbon of the anode itself is oxidized. Therefore, with the lapse of time, the anode loses its weight and eventually a flaw is developed. Particularly in the case of an anode made of a metal, the metal ions dissolved out from the anode get mixed into the solution. When the paint component is coagulated and precipitated, these metal ions are simultaneously coagulated and precipitated to the article. The coat which is consequently obtained suffers from poor anti-corrosion property or coarse coating surface. In the case of an anode made of carbon, the oxidation causes the anode to shed fine carbon particles into the solution. If the electrodeposition coating is continued with carbon particles contained in the solution, gritty prominences stand out on the surface of the coated article, with the rsult that the produced coat suffers from inferior appearance and deficient anti-corrosion property.

As materials for the anode which avoid release of metal ions, the use of high-grade stainless steel of SUS-316 or the like, or a noble metal such as platinum may be considered. Stainless steel, in addition to being expensive, is inevitably susceptible to release of metal ions, if only to a slight extent. The noble metal is too expensive to be feasible for the use contemplated. Carbon and graphite have a problem that they have poor processibility.

SUMMARY OF THE INVENTION

This invention is directed to solving the aforementioned problems suffered by the prior art and is aimed at the adoption, as a material for the anode, of a sintered mass of a metal oxide which is indissolvable or sparingly dissolvable and is an electric conductor. It is also aimed at disclosing a specific construction of the anode using a sintered mass of a metal oxide having poor moldability and processibility.

Another object of the present invention is to provide an electrode of a sintered metal oxide mass, which electrode has uniform electric current distribution, without suffering the temperature rise even though a large current flows in it, and can suppress the dissolution of the metal ions to as low a level as possible.

Still another object of the present invention is to provide a joined electrode having a desired size produced by joining a plurality of pieces made of sintered metal oxide together.

Further object of the present invention is to provide an electrode suitable as a pair of electrodes for cationic-electrodeposition coating an object.

BRIEF DESCRIPTION OF THE DRAWINGS

These and other objects, features and advantages of the present invention will be appreciated upon the reading of the description of the preferred embodiments of the present invention in conjunction with the attached drawings in which.

DETAILED DESCRIPTION OF THE PREFERRED EMBODIMENTS OF THE INVENTION

Figure 1:
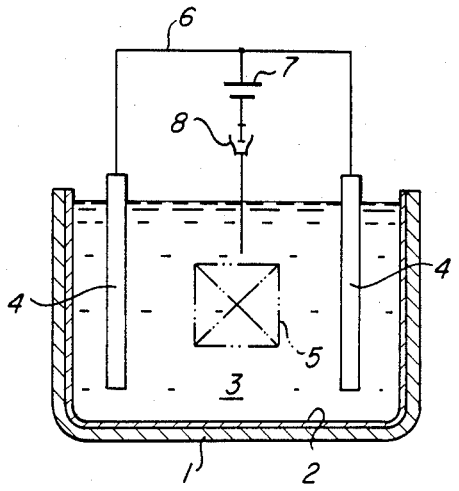
FIG. 1 is a lateral cross section view illustrating a system for carrying out the method for cationic electrodeposition coating.

The method for the cationic electrodeposition coating according to the present invention comprises the steps of placing an article subjected to coating in a paint solution, placing paired electrodes as opposed to the article in the paint solution, and applying a DC voltage between the article and the paired electrodes thereby forming on the surface of the article a coat of cationic electrodeposit, and is characterized by using, as the material for the paired electrodes mentioned above, a sintered mass of electroconductive metal oxide.

The sintered mass of metal oxide which is used for the paired electrodes, i.e. anodes, in the present invention abounds with electroconductivity. Typical examples of the sintered mass are a magnetic iron oxide represented by $FeO\text{-}Fe_2O_3$ which is popularly called magnetite and a magnetic metal oxide represented by $MO.nFe_2O_3$ which is called ferrite. In the formula, M denotes a divalent metal ion such as of Mn, Ni, Cu, Mg, Co, or Zn.

Because of the intended purpose, the sintered metal mass to be used in this invention is required to possess electric conductivity.

In the case of the aforementioned magnetite, since the specific resistance is sufficiently low, the electric conductivity does not pose any serious problem. In the case of the ferrite, the specific resistance is fairly variable with the composition. Generally, ferrites possess ferromagnetism. The ferrites of the type which are now used in the electronic industry as various transformers, permanent magnets, memory elements, and magnetic elements in television, radios, audio devices, and telecommunication devices possess varying specific resistance within a wide range of 100 Ω.cm to 100M Ω.cm. Among ferrites, some of those having large values of specific resistance may suffer from decline of current and evolution of heat and, consequently, prove to be unfit for use as anodes. The ferrite to be used as the material for the anode in the present invention is required to possess a low degree of specific resistance. In the ferrite, the electric conduction is caused by the hopping of electrons between $Fe^{2+}$ and $Fe^{3+}$. For making the ferrite possess a low degree of specific resistance, therefore, the composition of the ferrite must be excessively rich in $Fe_2O_3$. The sintered mass of metal oxide to be used as the anode for the cationic electrodeposition coating according to the present invention is desirably such a composition that the value of the volume specific resistance, determined in accordance with the specification of ASTM D 257-61, is not more than $10^5$ Ω.cm, preferably not more than $10^3$ Ω.cm and more preferably not more than 0.3 Ω.cm, at a temperature of 20° C. and a load voltage of 20 V. Specifically, this is a sintered mass of metal oxide having a spinel crystalline structure wherein iron oxide and metal oxides other than iron oxide (such as NiO, MnO, CoO, MgO, and CuO, ZnO and CdO, for example) are combined in a specific mixing ratio, e.g. 5 to 40 mol%, preferably 20–40 mol%, and more preferably about 40 mol% of such other metal oxides based on the total including iron oxide ($Fe_2O_3$). In the case of a magnetic iron oxide, it is desired to be composed of 30 to 50% of FeO and 50 to 70% of $Fe_2O_3$, preferably 35 to 45% of FeO and 65 to 55% of $Fe_2O_3$. A sintered mass composed of 44.0% of FeO, 53.5% of $Fe_2O_3$, 1.0% of $SiO_2$, 0.9% of $Al_2O_3$, 0.5% of CaO and 0.1% of MgO is employed as one of most preferable metal oxide.

The anti-corrosion property of the aforementioned magnetic iron oxide and ferrite as an anode excels that of the conventional material for the anode such as stainless steel (SUS 304, SUS 316, SUS 317) or carbon like graphite. Particularly, the ferrite is desirable because it sparingly dissolves out.

The metal oxide electrodes are known and the manufacturing processes thereof are also known, for instance, from Japanese Patent Publication Nos. 30151/1977 and 35394/1976. The electrode according to the present invention can be therefore produced using the aforementioned magnetic iron oxide or ferrite in accordance with the conventional processes.

Illustrative of such producing processes is one in which 5 to 40 mol% of at least one of metal oxides of MO (M denotes Mn, Ni, Co, Mg, Cu, Zn, or Cd) is added to 95 to 60 mol% of $Fe_2O_3$; heating is carried out in the air at 800° to 1000° C. for 1 to 3 hours after mixing in a ball mill; and the milled mass as cooled is crushed to obtain fine powder. The fine powder is molded under pressure, or a muddy substance obtained by adding water to this fine powder is cast-molded after pouring into a mold or by an appropriate method such as extrusion to obtain a desired shape of a molded product. The molded product thus obtained is sintered in an inert gas containing less than 5 vol. % of $O_2$, for instance, in the $N_2$ or $CO_2$ atmosphere at 1300° to 1400° C. for 3 to 5 hours and then gradually cooled in an inert gas containing less volume of $O_2$, such as $N_2$ or $CO_2$ atmosphere to obtain the intended electrode. The electrode thus obtained has a relatively high mechanical strength and exhibits the specific resistance fallen within the above-mentioned range.

In the above, although $Fe_2O_3$ and MO (M being the same as given above) are employed as starting materials, instead of $Fe_2O_3$, there may be employed at least one kind of Fe, FeO and $Fe_2O_3$ in such an amount that the amount is 95 to 60% when calculated as $Fe_2O_3$. Further, instead of the oxide such as MO, there may be employed a compound such as carbonate and oxalate which can produce their oxide upon heating.

The magnetite electrode can be obtained by the similar manner as mentioned above. For instance, pure $Fe_3O_4$ as starting material together with polyvinylalcohol as binder are granulated and then molded, followed by solid phase-sintering at an inert atmospher such as $CO_2$ gas at 1200° to 1300° C. to obtain the intended electrode.

The anode of the sintered mass of metal oxide only, according to the present invention, may be used in the shape of a flat plate, an angular column, or a circular rod. For the purpose of giving a large surface area to the anode and avoiding the non-uniform current distribution originating in the electrode based on the volume specific resistance of the sintered mass of metal oxide itself possibly induced when a large amount of electric current flows and further for the purpose of avoiding possible breakage of the anode such as due to mechanical impacts, the anode may be constituted such that the sintered mass of metal oxide is molded into a cylindrical tube with one end thereof closed and the cavity such a metal member as aluminum core, iron core, stainless steel core, copper core, or twisted strands of copper, particularly stainless steel material is inserted into the cylindrical body through an electroconductive material such as lead, solder, or conductive resin (e.g., in epoxy resin containing silver or graphite, commercially available under trademark designation of "Dotite").

When stainless steel is employed as a core material in the above-mentioned structure, it is possible to preclude rise of temperature of non-uniform of current distribution when a large amount of electric current flows. Owing to the characteristic property of stainless steel, the metal ions will dissolve out only to a slight extent even when the sintered mass is broken.

When the article to be coated by electrodeposition has a large, complicated structure, and even the inner surface of the box-like structure is required to be thoroughly and uniformly coated as in the case of an automobile body, the electrodepositing tank itself becomes bulky and the anode to be used therein also becomes large. In case the installation of the anode only in the lateral portion of the electrodepositing cell fails to give an ample throwing power and sufficient thickness, it is found necessary to have another anode installed further on the bottom surface of the electrodepositing cell.

When the anode is desired to be given an increased size so as to overcome the problems just mentioned above, since it is difficult to produce a sufficiently large tube of the sintered mass of metal oxide, it is desirable to obtain a large anode by preparing a one end-closed tube and a tube with the both ends thereof closed, then preparing a bar-shaped metal member as a core material, inserting the core material in the two tubes, and joining the core material fast to the tubes through an electroconductive material. The joining between the two tubes is desirably effected by engaging a tube of rigid resin around the adjoining portions of the two tubes bridging them and integrating the rigid resin tube with the two tubes of sintered mass by means of rigid resin filled therebetween.

The electrode to be installed on the bottom surface of the electrodepositing cell may be obtained by joining a covered lead wire to a magnetite or ferrite electrode, positioning a tube of rigid resin around the electrode so as to cover a part of the outer circumference of the tube of sintered mass as well as a part of the lead wire, while the rigid resin tube being bridged between the joint filling the space between rigid resin tube and joint with a curable resin and causing the curable resin to cure, and optionally having rings or caps of rigid resin screwed to the opposite ends of the rigid resin tube. When the electrode is constructed as described above, the core materials of the lead wire and the electrode are not attacked by the electrodepositing liquid in the electrodepositing cell. Consequently, the electrode may be easily set in arbitary position within the cell.

BEST MODE OF THE INVENTION

Now, the present invention will be described below with reference to working examples and controls. The value of each volume specific resistance given in these examples and controls were those obtained by the measurement carried out at 20° C. and 20 V in accordance with the method of ASTM D257-61.

EXAMPLE 1

(A) Preparation of Anode Plate

Anode plates having 160 mm in length, 50 mm in width, and 4 mm in thickness were prepared through sintering using magnetic iron oxide ferrites A through D having different values of volume specific resistance. The volume specific resistance values of the sintered masses (anode plates) thus obtained were as shown in Table 1-1.

TABLE 1-1

| Electrode | Component | | |
|---|---|---|---|
| | $Fe_2O_3$ | NiO | MnO |
| Ferrite A | 53 mol % | 30 mol % | 17 mol % |
| Ferrite B | 53 mol % | 30 mol % | 10 mol % |
| Ferrite C | 55 mol % | 45 mol % | 0 mol % |
| Ferrite D | 60 mol % | 40 mol % | 0 mol % |

Fine powder is produced by mixing at least two of NiO and MnO together with $Fe_2O_3$ at the above-showed ratios; well mixing them, for instance, in a ball mill; heating the mixture in the air at 800° to 1000° C. for 1 to 3 hours; and crushing the mass thus obtained after cooling. A muddy substance obtained by adding water to the fine powder is extrusion-molded into a desired shape of a molded mass. Then, the molded mass is sintered at 1300° to 1400° C. in the $N_2$ atmosphere containing less than 2 vol. % of $O_2$ for 3 to 5 hours and cooling is effected gradually in the $N_2$ gas containing less volume of $O_2$ to obtain the intended electrode.

(B) Electrodeposition Coating (1) Preparation of paint

Epoxy type polyamino resin having a resin base number 80 was neutralized at a neutralization equivalent 0.5 with acetic acid and dissolved in a deionized water containing ethylene glycol monoethyl ether acetate to produce varnish. The varnish thus prepared and 3 parts of carbon black and 6 parts of talc both based on 100 parts of the solid content of the varnish were subjected to dispersion in a mill for 20 hours to produce a cationic electrodepositing paint. The paint thus obtained was diluted with deionized water to a solid content of 12%.

(2) Method of coating

As illustrated in FIG. 1, a container which was obtained by providing a vinyl chloride resin lining 2 for a tank 1 of steel plate measuring 200 mm in length, 110 mm in width, and 150 mm in depth was filled with the paint solution 3 prepared as described above. Then, the sintered ferrite plates (paired electrodes) 4, 4 prepared as described in (A) above were fixed in the bath while their portions 10 mm downward from their respective upper ends stood over from the surface of the bath, whereas an article 5 to be coated which is made of steel plate treated with zinc phosphate (a cold-rolled steel plate SPC of 150×50×0.8 mm treated in advance with Bonderite #137 made by Nihon Parkerizing Co., Ltd.) was immersed in the aforementioned bath. The two paired electrodes 4, 4 were disposed symmetrically about the article 5 under treatment so that a coat would be uniformly formed on the article 5. These paired electrodes 4, 4 were interconnected with a lead wire 6. Further, the article 5 was electrically connected via a contact 8 to a power supply 7 which in turn was connected to the aforementioned lead wire 6. With the bath kept in the state described above, electric current was passed under the following conditions. The paired electrodes 4, 4 were positively charged and used as anodes and the article 5 used as a cathode, with the result that the cationic paint was deposited on the surface of the article 5.

(Electrodeposition Conditions)

Bath temperature: 30° C.
Distance between electrodes: 150 mm
Anode area: 75 $cm^2$
Cathode area: 75 $cm^2$
DC voltage: 130 V and 160 V
Period of current flow: 3 minutes After the electrodeposition coating, tap water at 20° C. was sprayed under pressure of 0.5 $kg/cm^2$ to wash the coated article for one minute. Then, the baking-curing was effected at 180° C. for 30 minutes. The electrodeposition coating was similarly conducted using the anodes produced from the different raw materials and the value of initial current and thickness of each coat were determined. The results were as shown in Table 1-2.

Control 1

Similarly with the procedure of Example 1 (B), the electrodeposition coating was carried out by using carbon (graphite electrode made by Tokai Carbon Co., Ltd. and marketed under trademark ("G 152") and stainless steel SUS 316 as materials for paired electrodes (anodes). With the use of the above anodes, the value of initial current at the electrodeposition and thickness of each coat were determined. The results were as shown in Table 1-2.

TABLE 1-2

| | | Example | | | | | | |
|---|---|---|---|---|---|---|---|---|
| | | Example 1 | | | | | | Control 1 |
| Voltage | Material anode | Magnetic iron oxide | Ferrite A | Ferrite B | Ferrite C | Ferrite D | Carbon | Stainless steel SUS 316 |
| 130 V | Thickness of deposited coat (μ) | 15 | 10 | 14 | 15 | 15 | 14 | 15 |
| | Value of initial current (A) | 2.0 | 1.1 | 1.8 | 1.8 | 1.9 | 1.8 | 1.9 |
| 160 V | Thickness of deposited coat (μ) | 21 | 16 | 19 | 20 | 20 | 20 | 20 |
| | Value of initial current (A) | 2.2 | 1.3 | 2.0 | 2.1 | 2.2 | 2.2 | 2.2 |
| Value of volume specific resistance (Ω · cm) | | less than $1 \times 10^{-1}$ | $2 \times 10^5$ | $1 \times 10^3$ | 90 | 0.3 | — | — |

Example 2

(A) Preparation of Anode Plate

Similarly with the procedure of Example 1 (A), anode plates were made by using magnetic iron oxide and ferrite D.

(B) Method for Test for Anti-corrosiveness

A 5 wt. % solution of acetic acid diluted with deionized water and a 5 wt. % solution of lactic acid diluted with deionized water were mixed at a mixing ratio of 1:1. The resultant mixture was placed in the similar container with a resin lining to that used in Example 1 (B). In the bath, the paired anode plates prepared as described in (A) above were set in such a position that their positions 10 mm downward from their respective upper ends stood out over the surface of the bath and a cold rolled SPC steel plate was set therein as a cathode. Electrolysis was carried out under the following conditions. The anode plates were tested for anticorrosiveness, with the loss of weight of each anode. The amounts of dissolution thus determined were as shown in Table 2-1.

(Conditions of electrolysis)

Bath temperature: 30° C.
Distance between anodes: 150 mm
Area of anodes and cathodes: 75 $cm^2$
DC current: 5 $A/dm^2$ and 0.01 $A/dm^2$ alternately used at intervals of 1 hour.
Period: 100 to 1000 hours.

Control 2

The same carbon and stainless steel SUS 316 as involved in Control 1 were used as anode and the anodes were tested for anti-corrosiveness by following the procedure of Example 2 (B). The amounts of anodes dissolved out in the test were as shown in Table 2-1.

TABLE 2-1

| Material of anode | Amount dissolved out (g/A · year) |
|---|---|
| Magnetic iron oxide | 50 |
| Ferrite E | 0.5 |
| Stainless steel SUS 316 | 10,000 |
| Carbon (graphite) | 1,000 |

Similarly to the above test, there were measured the dissolved amounts and resistances of electrode of nickel-ferrite ($Fe_2O_3$-NiO) in which the mol% of NiO is varied in the range of 5 to 45 mol%, the results being shown in Table 2-2.

The electrodes in this test were produced similarly in Example 1.

TABLE 2-2

| | NiO (mol %) | Dissolved-out amount (g/A · year) | Resistance (Ω · cm) |
|---|---|---|---|
| Ferrite D | 40 | 0.5 | 0.3 |
| Ni-ferrite I | 30 | 1.0 | 0.07 |
| Ni-ferrite II | 20 | 2.0 | 0.03 |
| Ni-ferrite III | 10 | 4.5 | 0.02 |
| Ni-ferrite IV | 5 | 7.0 | 0.01 |
| Ni-ferrite V | 2 | 12.0 | 0.005 |
| Ni-ferrite VI | 43 | 0.3 | 3.0 |
| Ferrite C | 45 | below 0.1 | 90.0 |

It is seen from Table 2-2 that 5–40 mol% of NiO is more excellent.

EXAMPLE 3

Figure 2:
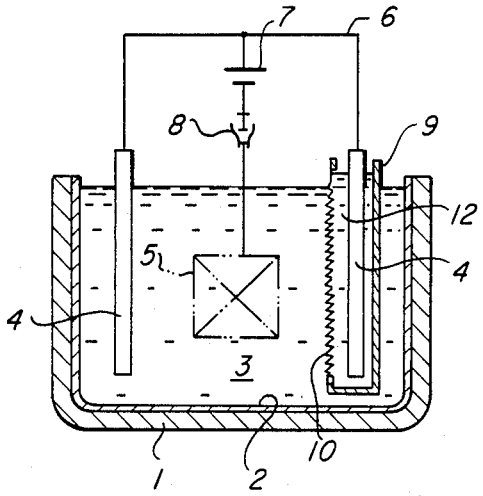
FIG. 2 is a lateral cross section view illustrating another system for carrying out the method for cationic electrodeposition coating.

In a field electrodeposition coating line, as illustrated in FIG. 2, a container in which a lining 2 such as of vinyl chloride is provided on the inner surface of a tank 1 of steel plate was filled with a paint solution 3. This paint had substantially the same composition as described in Example 1 (B). In the paint solution 3, the anode plates 4, 4' and an article 5 to be coated were immersed, with the anode plates 4, 4' connected to the anode of a DC power supply 7 by means of a lead wire 6 and the article 5 to the cathode of the power supply via a contact 8. In the present example, the anodes were used as a bare electrode construction illustrated in FIG. 1 and as a diaphragmed electrode construction. Specifically, the latter construction was obtained by setting up a diaphragm box 9 round the anode plate 4', disposing an ion-exchange resin membrane 10 in the plane of the diaphragm box 9 intervening between the anode plate 4' and the article 5 under treatment, and placing a diaphragm water 12 to fill the box 9. If the anode is formed in such a diaphragm-electrode construction as described above, the coat of electrodeposit is produced with improved quality because even if the material of the anode dissolves out slightly from the anode, the dissolved material is prevented from mingling into the paint solution.

Figure 3:
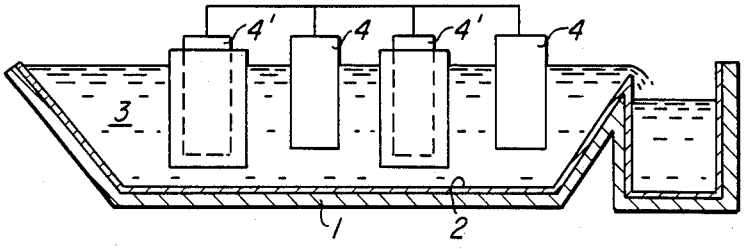
FIG. 3 is a longitudinal cross section view of yet another system for carrying out the method for cationic electrodeposition coating.

FIG. 3 illustrates the location of anodes in the longitudinal direction of an electrodepositing cell. In the figure, 4 denotes an anode in a bare construction and 4' an anode in a diaphragm-electrode construction.

Electrodeposition coating was carried out by following the procedure described in Example 1 (B) under the conditions described similarly. As materials for the anodes in this example, there were used stainless steel (SUS 316), carbon (graphite), and ferrite D.

The anodes made of these materials were operated for electrodeposition coating for a period of about one year. The weight reduction of each anode plate was measured. The results were as shown in Table 3. It is noted from this table that the anodes using ferrite suffered the least loss of weight. As regards the quality of coat of electrodeposit, while the coat produced by using the ferrite anodes posed no noticeable problem, that produced by using stainless steel anodes was found to have an increased Fe ion content and showed a rather coarse skin. In the case of the coat produced by using anodes of carbon, a part of carbon fell off and the paint solution was consequently found to contain finely divided particles of carbon, with the result that the produced coat suffered from a poor appearance.

TABLE 3

| Material of anode | Reduction in thickness (mm/year) |
|---|---|
| Ferrite | Less than 0.1 |
| Carbon | 1.0 |
| Stainless steel (SUS 316) | 3.0 |

From the foregoing description, it is clear that the cationic electrodeposition coating involved in this example entailed virtually no dissolution of the electrode during the electrodeposition because the anode plates were formed by using a sintered mass of metal oxide excelling in electroconductivity and that, consequently, there was no possibility that ions as impurity would mingle into the paint solution. Since the anodes were not oxidized by the oxygen generated near the anodes during the electrodeposition, there was no possibility that the anodes would be degraded by oxidation or partially separated off. Thus, the paint solution was free from adulteration with impure fine particles and the formed coat acquired a smooth, flawless skin. Furthermore, since the anodes were not degraded, they enjoyed increased durability, obviated the necessity for replacement, and acquired a merit of economizing both cost and labor.

Now, a typical concrete construction of the anodes of this invention will be described.

EXAMPLE 4

Figure 4:
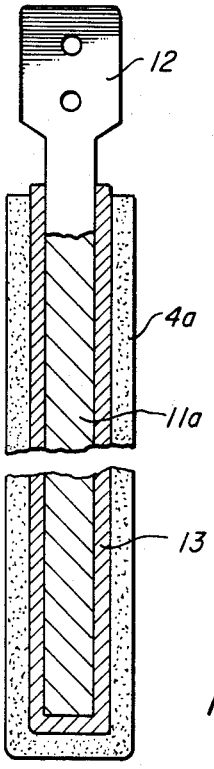
FIG. 4 is a longitudinal cross section view illustrating an electrode of this invention using a metal member as a core material.
Figure 5:
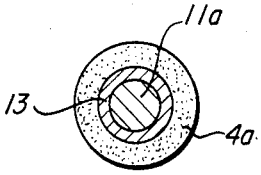
FIG. 5 is a lateral cross section view of the electrode in FIG. 4.

FIG. 4 and FIG. 5 represent an electrode according to the present invention. A bar of stainless steel **11*a* was provided at the upper end thereof with a terminal 1*a*. The shank of this stainless steel bar 11*a* was covered with a tube 4*a* of sintered mass of metal oxide closed at the lower end and having a U-shaped cross section, through an electroconductive material 13 such as electroconductive adhesive. In this electrode, since the sintered mass of metal oxide 4*a* was electrically connected over the entire inner wall surface thereof to the bar of stainless steel 11***a* through the electroconductive material 13, neither rise of temperature nor loss of uniformity of current distribution occurred when a large electric current flows. Further owing to the characteristics of stainless steel, there is no possibility that the sintered mass 4*a* would shed metal ions even if the sintered mass is broken to consequently make the stainless steel bar 11*a* exposed.

The cationic electrodeposition coating using the electrodes formed in the aforementioned construction with ferrite as a sintered mass of metal oxide (hereinafter referred to as "ferrite electrodes") is satisfactorily carried out similarly to those of Examples 1 through 3 as illustrated in FIG. 1 or FIG. 2.

The foregoing coating operation by cationic electrodeposition was carried out using Power-top U-30 (a paint produced by Nippon Paint Co., Ltd.) as a paint under a DC voltage of 250 to 280 V, with the length of the electrodes fixed at about 1800 mm, to coat about 15,000 automobile bodies per month of steel plate of about 50 $m^2$ for a total period of about one year. It was observed that both the ferrite electrodes used in the bare construction and those used as enclosed with the diaphragm box 9 showed only a very small loss of weight to such an extent that their diameters decreased from 28 mm to about 27.5 mm. Thus, it was found that the electrodes could still be in service. Further, the electric current from the electrodes was found to flow uniformly through the entire surface of ferrite bars and the electrodes themselves generated only slight so as to entail no particular problem.

For the purpose of comparison, the coating operation following the procedure of Example 4 was repeated by using other electrodes. Consequently, the following results were obtained.

Figure 6:
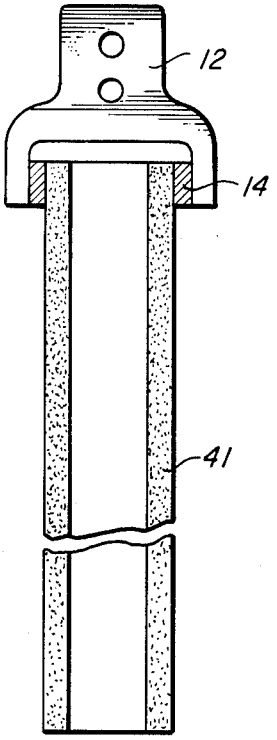
FIG. 6 and FIG. 7 are cross section views illustrating an electrode of the present invention formed solely of a sintered mass of metal oxide.

(1) When the electrodeposition coating was carried out by using ferrite electrodes which each comprised a sintered metal oxide tube 41 of ferrite with a terminal 12 attached to the upper end thereof through an electroconductive material 14 as illustrated in FIG. 6, heat generation occurred where the sintered tube 41 and the terminal 12 were joined and the current distribution was different between the terminal side and the free end side of the sintered tube 41. There was only a small flow of current at the free end side. The reduction in the outside diameter after about one year service was somewhat larger on the terminal side; the diameter decreased from 28 mm to about 26 mm.

Figure 7:
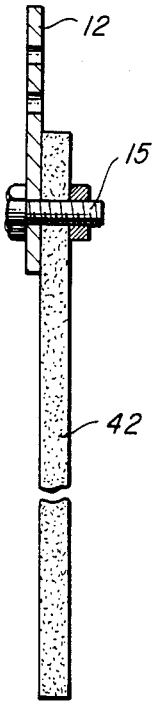

(2) When the electrodeposition coating was performed by using ferrite electrodes which each comprised a sintered metal oxide plate 42 of ferrite with a terminal 12 attached to the upper end thereof through a joint 15 as illustrated in FIG. 7, heat generation similarly occurred where the sintered plate 41 and the terminal 12 were joined and the current distribution was different between the terminal side and the free end side of the sintered plate 41. There was only a small flow of current at the free end side. The reduction in the wall thickness after about one year service was somewhat larger on the terminal side; the thickness decreased from 5 mm to about 4 mm.

(3) When the electrodeposition coating was similarly effected by using stainless steel SUS 316 and ferrite electrodes of this invention as illustrated in FIG. 4 as anode, the flow of electric current was substantially uniform and heat generation by the electrodes themselves was slight. The reduction in outside diameter of the electrodes after about one year service was very large such that the diameter decreased from 16 mm to about 3 mm. Some of the electrodes even sustained fracture due to heavy decrease in the diameter.

(4) When the electrodeposition coating was similarly carried out by using stainless steel SUS 316 as anode, the electrodes sustained similarly fracture as in the case (3) above. The paint solution contained iron ions to such an extent as to induce partial coagulation of paint. The produced coat developed a coarse skin, such as an uneven appearance and exhibited inferior anti-corrosiveness.

(5) When the electrodeposition coating was similarly carried out by using, as anode, iron SS 41 and ferrite electrodes of this invention constructed as illustrated in FIG. 4, the iron anode dissolved out and fractured in several days of service.

(6) When the electrodeposition coating was similarly made by using, as anode, copper, and aluminum, and ferrite electrodes of this invention constructed as illustrated in FIG. 4, the anodes of copper and aluminum dissolved out so much as to sustain fracture in several days of service.

As described above, the ferrite electrode illustrated in FIGS. 4–5 suffers no elevation of temperature even if a large volume of electric current is flown, and provides uniform distribution of electric current because this electrode is formed by using a stainless steel as core and covering the outer periphery of this core successively with an electroconductive material and a sintered mass of metal oxide.

Since this electrode uses stainless steel as its metal member, the characteristics of stainless steel prevents the metal member from being appreciably dissolved out even if the sintered mass of metal oxide sustains cracks due to external impacts, for example, and this electrode is free from a coarse skin of the coat due to the dissolution of copper ions or aluminum ion into the paint or inferior anti-corrosiveness, unlike the case where the electrode uses copper or aluminum as the metal member.

EXAMPLE 5

This example shows an electrode formed by joining end to end tubes of sintered mass of metal oxide.

Figure 8:
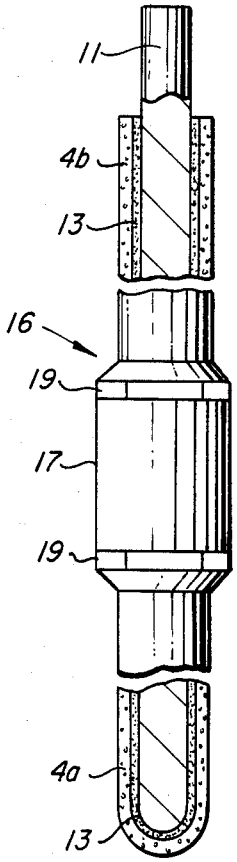
FIG. 8 is a cross section view illustrating a electrode of this invention, wherein sintered masses of metal oxide are joined to each other.
Figure 9:
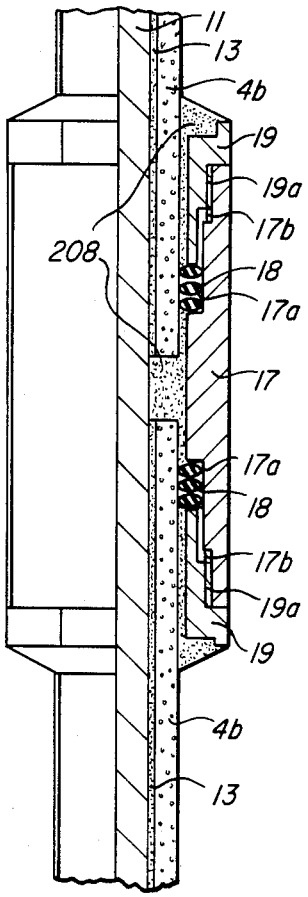
FIG. 9 is a cross section view of the essential part of the electrode of FIG. 8.

FIG. 8 represents this electrode in its entirely. FIG. 9 represents the essential part of this electrode.

A bar-shaped metal member 11 is made of copper, iron, or stainless steel. The outer periphery of this metal member 11 is covered, through an electroconductive member 13 such as of lead, solder, or electroconductive adhesive, with a sintered mass of metal oxide 4*a* with one end thereof closed having a U-shaped cross section and a sintered mass of metal oxide 4*b* formed with both end thereof opened. Round the opposed portions of the upper and lower sintered masses 4*a*, 4*b*, there is provided a connecting member 16 made of resin in the shape of a sheath.

This connecting member 16 is formed by bridging a tubular member 17 made of rigid resin such as fluorine resin (such as a resin marketed under trademark "Teflon"), polyvinyl chloride, or nylon round the outer peripheries of the opposed portions of the sintered masses 4*a*, 4*b*, inserting O rings 18 formed of Teflon, leather, or rubber round stepped portions 17*a*, 17*a* formed at opposite positions on the inner surface of the resin member 17 while being held in contact with the outer peripheries of the sintered masses of metal oxide 4*a*, 4*b*, and screwing members 19, 19 of the shape of hollow caps made of rigid resin such as Teflon or polyvinyl chloride, provided on the outer peripheries thereof with male threads 19*a*, 19*a*, to female threads 17*b*, 17*b* formed round the opposite edges of the inside of the resin member 17. Because of the screw attachment of the rigid resin members 19, 19, the O rings 18 have their leading ends pressed down to establish tight contact between the rigid resin member 17 on the outside and the sintered masses 4*a*, 4*b* on the inside. After the connecting member has been formed in the construction described above, liquid curable resin 20 such as, for example, two-pack curable type epoxy resin, polyester resin, or polyvinyl chloride sol which possesses settability is inserted into a void space formed between the sintered masses of metal oxide 4*a*, 4*b* and the rigid resin members 19, 19 and is caused to cure at room temperature or an elevated temperature. The liquid resin 20 is inserted in the empty space defined by the opposed edge surfaces of the sintered masses 4*a*, 4*b*, the outer periphery of the metal member 11, and the rigid resin member 17 before the screwing of the rigid resin members 19, 19. This resin 20 may be anything so long as it does not dissolve into the paint.

Owing to such a coverage structure with the resin, all the voids round the connecting member 16 are filled up, so that no paint solution is allowed to enter into the interior of the connecting member. The resin itself is not dissolved out into the paint solution. The connecting member 16 enjoys ample strength because the adhesive strength of the curable resin 20 and the mechanical strength of the rigid resin members 17, 19, 19 compensate for a bending force, for example.

Electrodes of the construction described above using ferrite or magnetite tube as the sintered masses of metal oxide were used as anodes continuously for two years in the coating by cationic electrodeposition under the same conditions as in Example 4. Then, the electrodes were examined. But, no absorbability was found in the connecting members. The electrodeposited coats produced were normal and acceptable.

The joining construction for two electrodes contemplated by this invention is applicable not only to the electrodes for cationic electrodeposition but also to those for other than electrodeposition.

EXAMPLE 6

Figure 10:
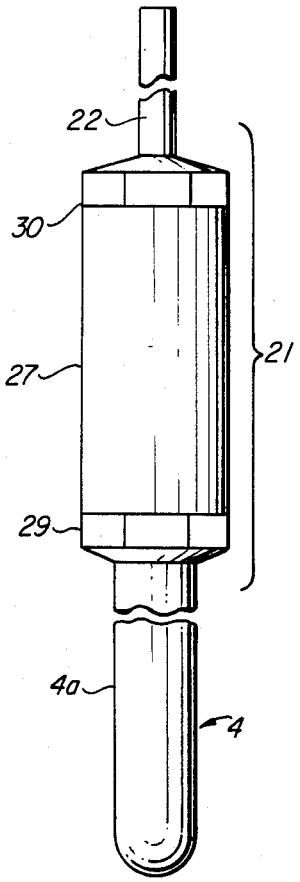
FIG. 10 is a front view illustrating an electrode having a lead wire connected thereto.
Figure 11:
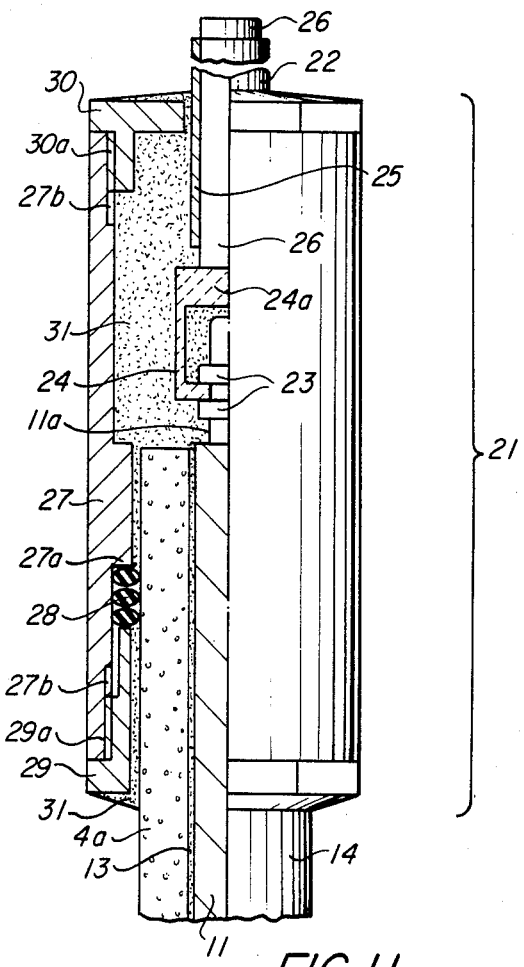
FIG. 11 is a cross section view of the essential part of the electrode in FIG. 10.

This example illustrates the construction for joining between an electrode and a lead wire. FIG. 10 represents a side view of the electrode and FIG. 11 does a cross section of the essential part thereof.

A reference numeral 4 is an electrode in which the outer circumference of a bar-shaped metal member 11 of copper, iron, stainless steel or the like as a core is covered with an electroconductive material 13 such as lead, solder, or an electroconductive adhesive, and sintered mass 4*a* of metal oxide. To the upper end of the electrode, a sheathed lead wire 22 such as, for example, a 600-V cable having a vinyl sheath insulated with crosslinked polyethylene or a vinyl sheath insulated with vinyl is connected through a connecting part 21.

The aforementioned connecting member 21 will be described more specifically. The metal member 11 is provided at the upper end thereof with a male thread 11*a*, to which a pressure terminal 24 for connecting the lead wire is fastened by nuts 23, 23. To the pressing portion 24*a* of the pressure terminal 24, a conductor 26 such as, for example, stranded copper wire of the lead wire 22 exposed by the removal of a sheath 25 is attached under pressure such as by caulking. Thus, the electrode 4 and the sheathed lead wire 22 are connected to each other.

A tubular rigid resin member 27 made of Teflon, polyvinyl chloride or the like is mounted round the outer peripheries of the electrode 4 and the sheathed lead wire 22 bridging them. On the electrode 4 side of the tubular rigid resin member 27, an O ring 28 such as of Teflon, leather, rubber or the like is inserted round a stepped portion 27 formed on the inside of the member 27 while held in contact with the outer periphery of the sintered mass 4*a* of metal oxide. At the same time, a rigid resin member 29 formed of Teflon or polyvinyl chloride in the shape of a hollow cap and provided on the outer periphery thereof with a male thread 29*a* is screwed to a female thread 27*b* formed at the edge on the inside. By the screwing of this rigid resin member 29, the O rings 28 are pressed by its tip to establish tight contact between the outer rigid resin member 27 and the sintered mass 4*a* of metal oxide. On the sheathed lead wire 22 side, a rigid resin member 30 formed of Teflon or polyvinyl chloride in the shape of a hollow cap and provided on the outer periphery thereof with a male thread 30*a* is screwed to the female thread 27*b* formed similarly at the edge on the inside.

After the connecting member is formed in the construction described above, liquid curable resin 31 such as, for example, two-pack curable type epoxy resin, polyester resin, or polyvinyl chloride sol which has curability is inserted into the empty space between the sintered mass 4*a* of metal oxide and the rigid resin members 29, 27 and into the empty space formed by the sheath 25 and the conductor 26 of the sheathed lead wire 22, the pressure terminal 24, the nuts 23, the male thread 11*a* of the metal member 11, and the rigid resin members 30, 27 and is then caused to cure at room temperature or at an elevated temperature. This resin 31 may be anything so long as it is liquid or sol and it will not dissolve out into the paint solution.

All the voids around the connecting member 21 are filled up by the treatment with resin mentioned above. Thus, there is absolutely no possibility of internal parts being exposed directly to the solution used. High electrical insulating property and high liquid-tightness can be assured. When the connecting member 21 is immersed into the paint solution from the sheathed lead wire 22, it is only through the sintered mass 4*a* of metal oxide that electric current is passed to the paint solution.

Figure 12:
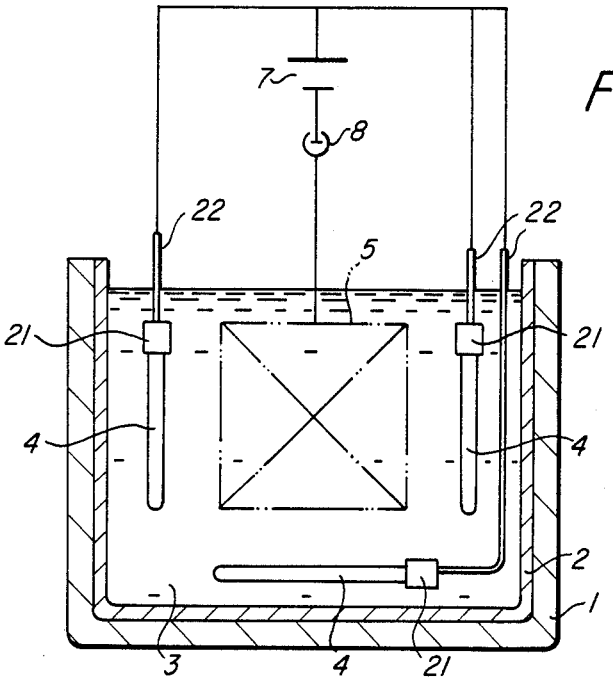
FIG. 12 and FIG. 13 are cross section views illustrating the electrode shown in FIG. 10 as laid out for actual service.
Figure 13:
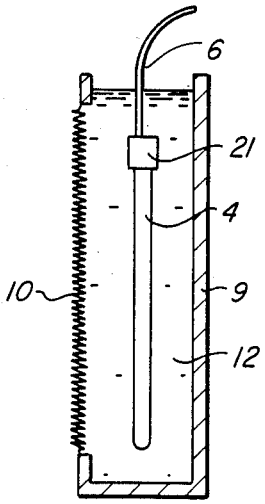

For electrodes constructed as described above to be used in the coating by cationic electrodeposition coating, they are immersed in an electrodepositing cell as illustrated in FIG. 12 or FIG. 13.

Similarly to Example 4, Power-top U-30 (produced by Nippon Paint Co., Ltd.) was employed as paint and the electrodeposition coating was carried out under the application of a DC voltage of 250 to 300 V for 3 minutes. When the article 5 subjected to coating was an automobile body, throwing power was satisfactory even on the inner surface of a box-shaped body such as a floor member. Comparing the case where one electrode of the same construction as described above was additionally used at the bottom of the cell as illustrated in FIG. 12 with the case where such an additional electrode was omitted, the coat obtained on the inner surface such as of the floor member under the same conditions had a greater thickness and better quality in the former case. For evaluation of durability of the electrodes the electrodeposition coating were continuously carried out for about one year. Upon examination of the electrode, the sintered mass 4*a* of metal oxide was observed to have lost volume so slightly as to pose no particular problem and the resin-treated portions at the sheathed lead wire 22 and the connecting member 21 immersed in the paint solution were not found to have developed any abnormality. Further, the paint solution showed no sign of entry of dissolved ions or other foreign matters. Every coat obtained by the treatment had highly desirable quality.

Although the working examples given above are explained with reference to electrodes for cationic electrodeposition coating. The electrodes according to the present invention are not limited thereto, but may be used for power electrodeposition coating or other forms of coating.

As mentioned above, according to the present invention, the surface area of the electrode can be increased by designing the metal oxide sintered mass in a cylindrical form. On the other hand, the invention has the advantage that the electrode can be mechanically strengthened by inserting the core material of Cu, stainless steel, or the like into the cylindrical body.

In case the electrode is made of the metal oxide sintered mass alone, the temperature at its top end rises when a great current flows in the electrode, and the distribution of the current flown from the electrode becomes uneven. On the other hand, in the present invention, such a problem can be avoided because the metal member is inserted into the cylindrical body. In addition, according to the joining method of the present invention, a large size of the electrode can be arbitrarily obtained.

In the joined-structure electrode according to the present invention, the outer circumference of the sheathed lead wire is covered with the metal oxide sintered mass to be in contact with the liquid; and the joint between the lead wires is covered with the resin. Therefore, an appropriate number of the electrodes can be arbitrarily and easily placed in a suitable location of the electrodeposition cell. Accordingly, it is possible to attain an excellent throwing power and a desired film thickness of the coating even in the case of coating a large size of a part to be coated, such as automobile body.

Having thus described the invention, what is claimed as novel and as sought for Letters Patent of the United States is:

1. A process for manufacturing an electrode, which comprises:

(a) inserting a metal member in the form of a bar into a cylindrical hollow metal oxide sintered mass comprising magnetite, ferrite or a mixture thereof having the lower end thereof closed;

(b) securing the metal member in the interior of the metal oxide sintered mass by means of a conductive material; thereby exposing the metal member at the upper end portion of the sintered mass;

(c) connecting a sheathed lead wire having two ends to the exposed portion of the metal member;

(d) attaching a cylindrical hollow member of a hard resin having such a length as to cover both ends of the lead wire and the metal member at the connected portion onto the outer circumference of the upper end of the cylindrical hollow member; and (e) filling the gap between the inner circumference of the cylindrical hollow member and the outer circumferences of the lead wire and metal member with a liquid curable resin; and curing said resin, and wherein the upper end of the metal member is projected from the electrode body, the sheathed lead wire is connected to the projected portion of the metal member, a cylindrical hollow member of hard resin is so attached to the upper end of the electrode body so as to bridge over the joined portion, and the gap between the inner circumference of the cylindrical hollow member and the outer circumference of the electrode body and the lead wire is filled with a cured resin of a liquid curable resin.

2. The process as claimed in claim 1, wherein said metal member is selected from the group consisting of aluminum, iron, copper and stainless steel in the form of a bar.

3. The process as claimed in claim 2, wherein said bar is made of twisted wires.

4. The process as claimed in claim 2, wherein said bar is made of stainless steel.

5. The process as claimed in claim 1, wherein said conductive material is selected from the group of lead, solder or a conductive resin adhesive.

6. The process as claimed in claim 1, wherein said cylindrical hollow metal oxide sintered mass comprises iron oxide and another oxide selected from the group consisting of NiO, MnO, CoO, MgO, CuO, ZnO and CdO.

7. The process as claimed in claim 1, wherein said hard resin is selected from the group consisting of polytetrafluoroethylene and polyvinyl chloride.

8. The process as claimed in claim 1, wherein the liquid curable resin is selected from the group consisting of epoxy resin and polyester resin.

* * * * *

UNITED STATES PATENT AND TRADEMARK OFFICE

CERTIFICATE OF CORRECTION

PATENT NO. : 4,621,420

DATED : November 11, 1986

INVENTOR(S) : Yoshinobu Takahashi et al

It is certified that error appears in the above-identified patent and that said Letters Patent is hereby corrected as shown below:

On the title page:

-- Section /30/ has been ommitted from the Letters Patent. The following information should be recorded:

/30/ Foreign Application Priority Data
August 12, 1981 - Japan No. 119557/1981 --

Signed and Sealed this

Third Day of February, 1987

*Attest:*

DONALD J. QUIGG

*Attesting Officer*

*Commissioner of Patents and Trademarks*